US011825876B2

(12) United States Patent
Murillo

(10) Patent No.: US 11,825,876 B2
(45) Date of Patent: Nov. 28, 2023

(54) ELECTRICALLY POWERED SUCTION ASHTRAY FOR PIPE BOWLS

(71) Applicant: Miguel Fernando Murillo, Los Angeles, CA (US)

(72) Inventor: Miguel Fernando Murillo, Los Angeles, CA (US)

( * ) Notice: Subject to any disclaimer, the term of this patent is extended or adjusted under 35 U.S.C. 154(b) by 184 days.

(21) Appl. No.: 17/506,007

(22) Filed: Oct. 20, 2021

(65) Prior Publication Data

US 2022/0125104 A1 Apr. 28, 2022

Related U.S. Application Data

(60) Provisional application No. 63/106,010, filed on Oct. 27, 2020.

(51) Int. Cl.
*A24F 19/00* (2006.01)
*A24F 9/10* (2006.01)

(52) U.S. Cl.
CPC ..... *A24F 19/0042* (2013.01); *A24F 9/10* (2013.01)

(58) Field of Classification Search
None
See application file for complete search history.

(56) References Cited

U.S. PATENT DOCUMENTS 2,029,192 A * 1/1936 Ray ..... A24F 19/0042 55/385.6
2,747,101 A * 5/1956 Hammond, Jr. .... A24F 19/0042 55/385.6
2,788,085 A * 4/1957 Waller ..... A24F 19/0042 242/129
2,851,156 A * 9/1958 Thompson ..... A24F 19/00 15/313
3,797,205 A * 3/1974 Weisskopf ..... B01D 46/00 55/467
3,958,965 A * 5/1976 Raczkowski ..... A24F 19/0042 55/473
3,966,442 A * 6/1976 Waters ..... B01D 53/02 55/482
4,043,776 A * 8/1977 Orel ..... B01D 46/30 96/138
4,148,618 A * 4/1979 Christenson ..... A24F 19/0042 55/467
6,523,544 B1 * 2/2003 Ritter ..... A24F 19/0042 131/241

* cited by examiner

*Primary Examiner* — Eric Yaary
(74) *Attorney, Agent, or Firm* — Pete Adams Law, PLLC

(57) ABSTRACT

The suction ashtray device is portable and is preferably battery powered with an electric motor. The suction ashtray device can include a rechargeable battery that can be charged using a power cable such as a Universal Serial Bus cable. A pipe bowl can be placed on or above an inverted cone-shaped top. When the suction ashtray is powered on, ash and any other particles are vacuumed through the top into a catch compartment. Some embodiments can include an ashtray attachment. The ashtray attachment connects to the cyclone top. The ashtray attachment includes a plurality of grooves able to hold a cigarette or similarly sized smoking apparatus. A user can place a cigarette in a groove so that the ash can fall into the cyclone top.

20 Claims, 11 Drawing Sheets

ELECTRICALLY POWERED SUCTION ASHTRAY FOR PIPE BOWLS

CROSS-REFERENCE TO RELATED APPLICATIONS

This is a U.S. Nonprovisional patent application filed under 35 U.S.C. 111(b). This application claims priority to U.S. Design patent application No. 29/801,041 filed Jul. 26, 2021, U.S. Design patent application No. 29/801,011 filed Jul. 26, 2021, and U.S. Provisional Patent App. No. 63/106,010 filed Oct. 27, 2021.

BACKGROUND OF THE INVENTION

1. Field of the Invention

The present invention relates generally to pipes for smoking cannabis or tobacco, and more specifically to electrically powered pipe bowl cleaners using suction.

2. Description of Related Art

Pipe bowls become heavily coated in ash and other remnants after smoking substances. Users often have to use reamers, pokers, or other manual or mechanical methods to remove the remnants. Manually or mechanically removing remnants is time consuming and often some residue remains after the process. Manual or mechanical removal can be messy unless an additional collection receptacle is also employed. Further, manual devices such as reamers or pokers can scrape and damage bowls. If the remnants are not removed from the pipe bowl, the user will often end up sucking the remnants into a water pipe. Thus, current methods of cleaning pipe bowls are deficient.

There is a need in field of pipe bowl cleaners for an efficient device using electrically powered vacuum suction. Vacuum suction is an efficient and clean system and method for removing ash and other remnants from pipe bowls.

SUMMARY OF THE INVENTION

Electrically powered suction pipe bowl cleaners are disclosed herein. The suction ashtray device is portable and is preferably battery powered. The suction ashtray device can include a rechargeable battery that can be charged using a power cable such as a Universal Serial Bus cable. A pipe bowl can be placed on or above an inverted cone-shaped (cyclone) top. When the suction ashtray is powered on, ash and any other particles are sucked (vacuumed) through the top into a catch compartment. A housing contains internal electrical and mechanical components. The housing encases a fan that is powered by an electric motor. The fan is preferably a fan blade or propeller operatively connected to the electric motor. A tray supports the housing and other components.

In some embodiments, a tray is located on top of a base which supports the ashtray system. The base can hold a battery and electrical wiring. Alternatively, the battery can be stored inside the housing with other components including the electric motor. Embodiments can also include an ashtray attachment. The ashtray attachment connects to the cyclone top. For example, the ashtray attachment can include male threads and the cyclone top can include female threads so that a user can fasten the components together. The ashtray attachment includes a plurality of grooves able to hold a cigarette or similarly sized smoking apparatus. A user can place a cigarette in a groove so that the ash can fall into the cyclone top.

DETAILED DESCRIPTION OF THE INVENTION

Figure 1:
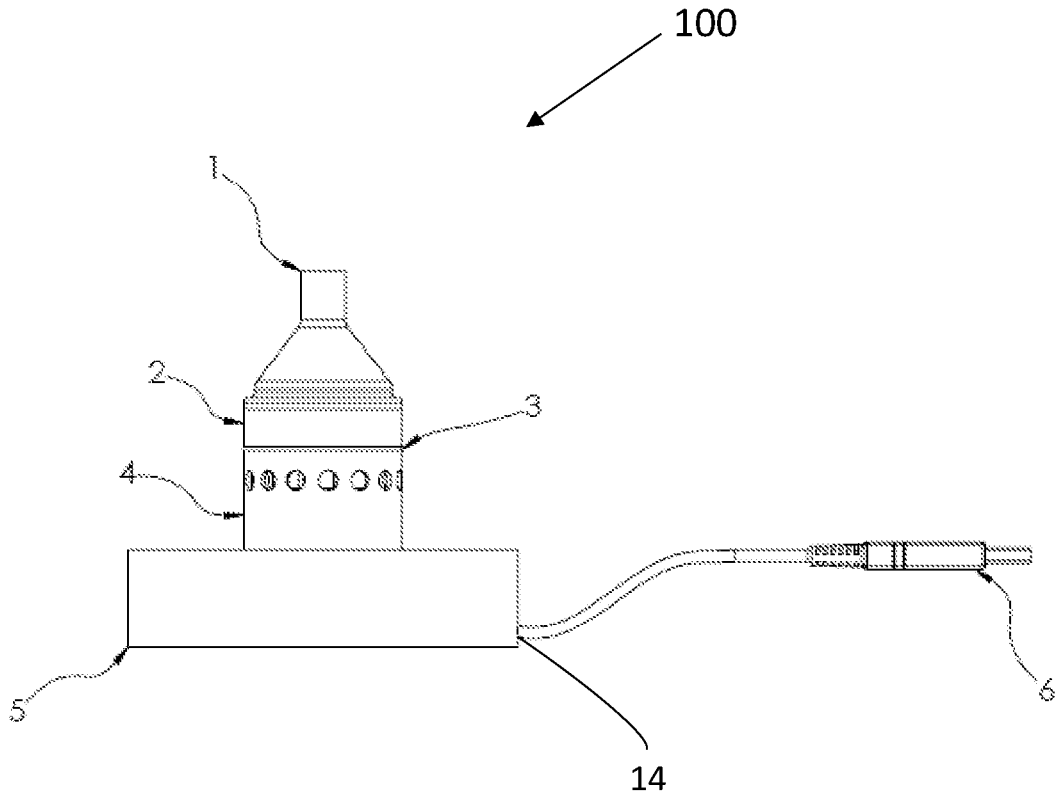
FIG. 1 illustrates a front view of an embodiment of an electrically powered suction ashtray system.

The following descriptions relate principally to preferred embodiments while a few alternative embodiments may also be referenced on occasion, although it should be understood that many other alternative embodiments would also fall within the scope of the invention. The embodiments disclosed are not to be construed as describing limits to the invention, whereas the broader scope of the invention should instead be considered with reference to the claims, which may be now appended or may later be added or amended in this or related applications. Unless indicated otherwise, it is to be understood that terms used in these descriptions generally have the same meanings as those that would be understood by persons of ordinary skill in the art. It should also be understood that terms used are generally intended to have the ordinary meanings that would be understood within the context of the related art, and they generally should not be restricted to formal or ideal definitions, unless and only to the extent that a particular context clearly requires otherwise. Synonymous or equivalent terms may be used in different instances in the specification and should not be construed to limit the invention.

For purposes of these descriptions, a few wording simplifications should also be understood as universal, except to the extent otherwise clarified in a particular context either in the specification or in particular claims. The use of the term "or" should be understood as referring to alternatives, although it is generally used to mean "and/or" unless explicitly indicated to refer to alternatives only, or unless the alternatives are inherently mutually exclusive. Furthermore, unless explicitly dictated by the language, the term "and" may be interpreted as "or" in some instances. When referencing values, the term "about" may be used to indicate an approximate value, generally one that could be read as being that value plus or minus half of the value. "A" or "an" and the like may mean one or more, unless clearly indicated otherwise. Such "one or more" meanings are most especially intended when references are made in conjunction with open-ended words such as "having," "comprising" or "including." Likewise, "another" object may mean at least a second object or more. Thus, in the context of this specification, the term "comprising" is used in an inclusive sense and thus should be understood as meaning "including, but not limited to." As used herein, the use of "may" or "may be" indicates that a modified term is appropriate, capable, or suitable for an indicated capacity, function, or usage, while considering that in some circumstances the modified term may sometimes not be appropriate, capable, or suitable. Directional terms such as left, right, front, rear, top, and bottom are non-limiting and do not restrict the invention to particular orientations. Example quantities and sizing dimensions are described herein but do not limit the invention, as other sizes and quantities can be implemented. "Plurality" means one or more in this specification and any claims in the application.

FIG. 1 illustrates a front view of an embodiment of an electrically powered suction ashtray system 100. The suction ashtray device 100 is portable and is preferably battery powered. The suction ashtray device 100 can include a rechargeable battery that can be charged using a power cable 6 such as a Universal Serial Bus (USB) cable. A pipe bowl can be placed on (or above) an inverted cone-shaped (cyclone) top 1. Below the cyclone top 1 is a catch compartment 2. When the suction ashtray 100 is powered on, ash and any other particles are sucked (vacuumed) through the top 1 into the catch compartment 2. A housing 4 contains internal electrical and mechanical components (shown in FIG. 2). A first gasket 3 provides a seal between the catch compartment 2 and the housing 4. A tray 5 supports the housing 4 and other components while providing an outlet 14 for the power cable 6 to connect.

Figure 2:
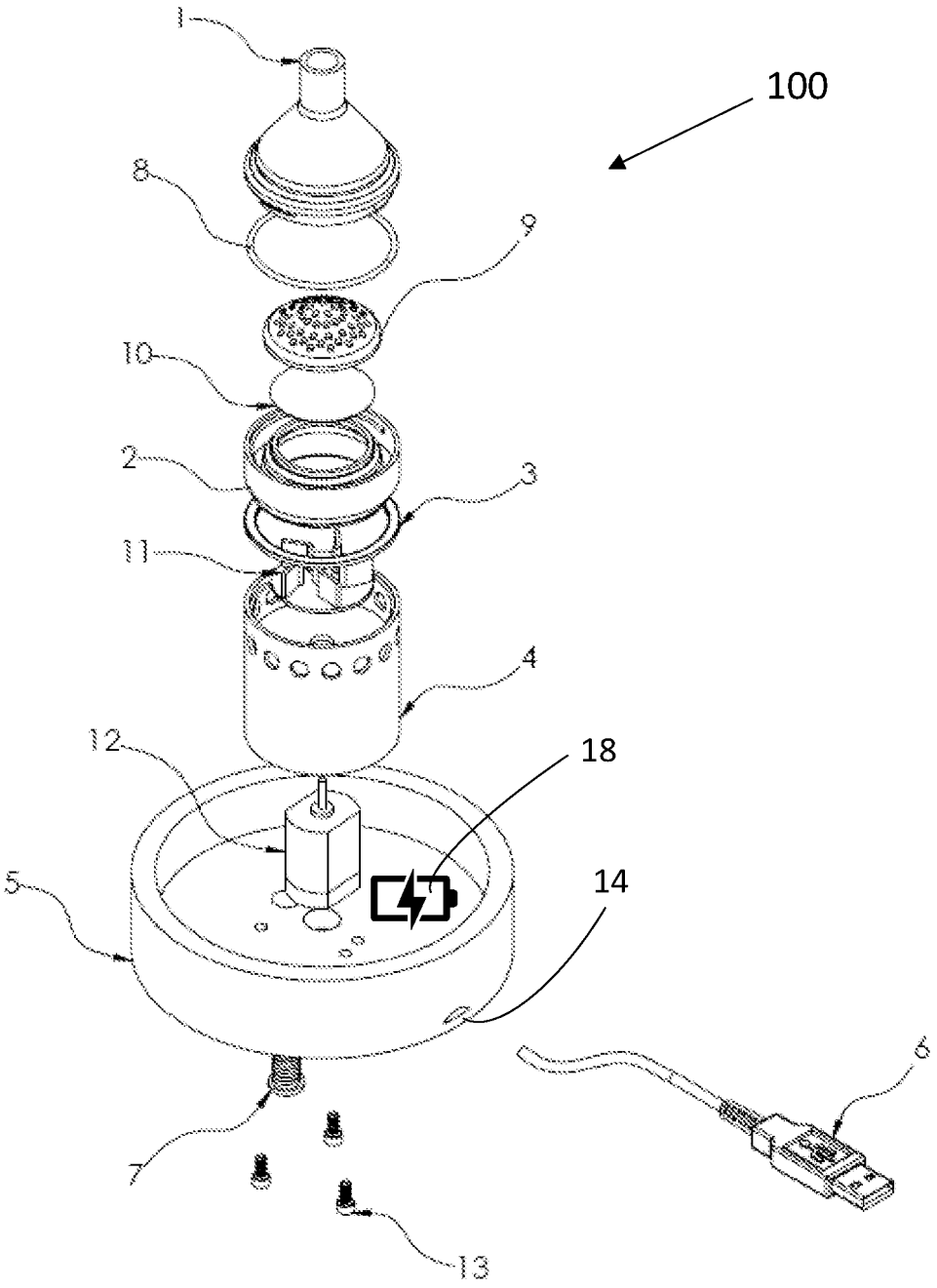
FIG. 2 illustrates an exploded perspective view of an embodiment of an electrically powered suction ashtray system.

FIG. 2 illustrates an exploded perspective view of an embodiment of an electrically powered suction ashtray system 100. A second gasket (e.g. O-ring) 8 provides a seal between the cyclone top 1 and the catch compartment 2. The suction ashtray 100 further includes a cone filter 9 and an air filter 10. As aforementioned, a first gasket 3 provides a seal between the catch compartment 2 and the housing 4. The housing 4 encases a fan 11 that is powered by an electric motor 12. The fan 11 is preferably a fan blade or propeller operatively connected to a high speed electric motor 12. The housing 4 is operatively connected to the tray 5, preferably using threaded fasteners such as mounting screws 13. Although the example embodiment suction ashtray system 100 shows three mounting screws 13, more or less fasteners can be employed. It is also contemplated that the housing 4 could be permanently affixed to the tray 5. A power switch (e.g. push button) 7 for controlling the on/off operation of the suction ashtray 100 is shown mounted to the bottom of the tray 5. The push button 7 can alternatively be located on the sides or on top of the tray 5. A small outlet opening 14 in the tray 5 enables a power cable 6 to connect. The power cable 6 is electrically connected to a battery 18 which powers the electric motor 12. The battery 18 and electric motor 12 are preferably stored inside the housing 4. Using a power cable 6 enables the suction ashtray 100 to be easily charged. Alternatively, the power cable 6 can connect to an electric motor 12 to provide electrical power without requiring a battery 18.

Although lithium ion batteries that can be recharged using a USB cable are preferred, other batteries such as alkaline can be employed. The rechargeable battery 18 can be a 7.2 Volt lithium-ion polymer ("LiPo") battery. It can also be powered using a 3.5 Volt LiPo battery, alkaline batteries (e.g. AA, AAA), lithium battery, etc. Any combination of batteries can be implemented that can produce approximately 3.5 Volts or more in power. Other embodiments with lower power requirements can utilize batteries with lower voltages. Alternatively, the suction ashtray 100 can be powered using an NC power source or plug in. Further, an alternative embodiment of the suction ashtray system 100 could be powered by connecting a power cable to standard 110V/120V or 220V/240V wall sockets.

Figure 3:
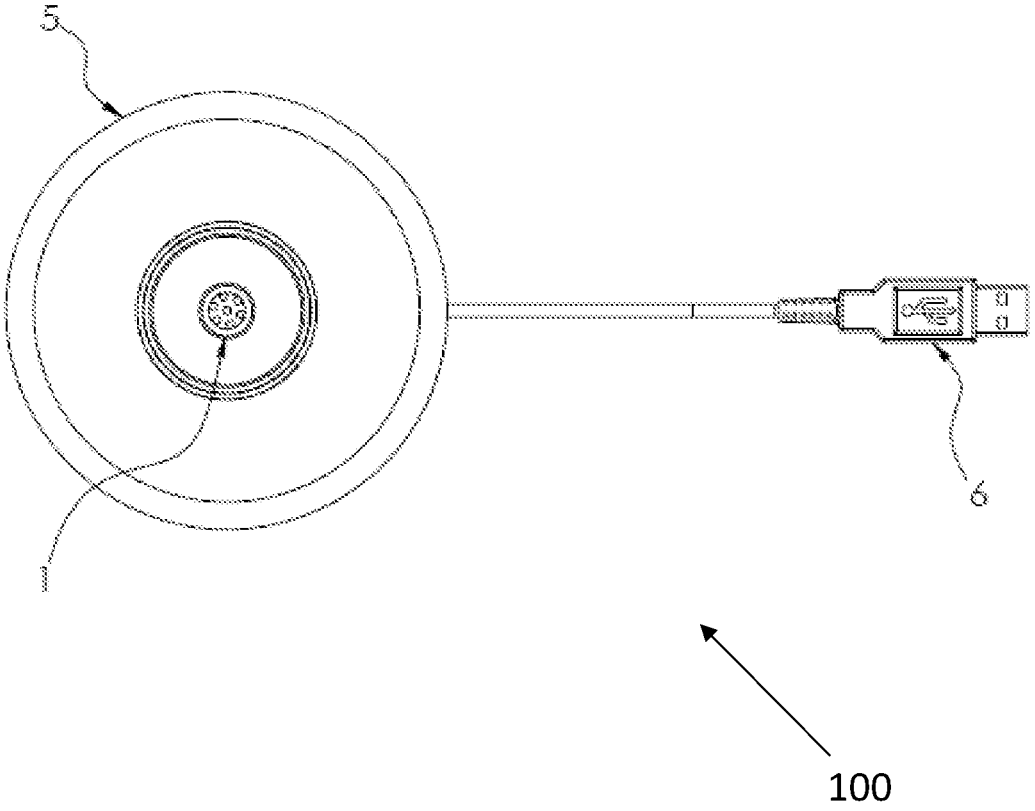
FIG. 3 illustrates a top view of an embodiment of an electrically powered suction ashtray system.

FIG. 3 illustrates a top view of an embodiment of an electrically powered suction ashtray system 100. The top 1 is preferably cyclone-shaped to enable a strong suction force. The tray 5 is wider than the housing 4 and preferably cylindrical shaped that is partially hollowed out. The tray 5 floor supports the housing 4 and can also function as an ash tray/collector.

Figure 4:
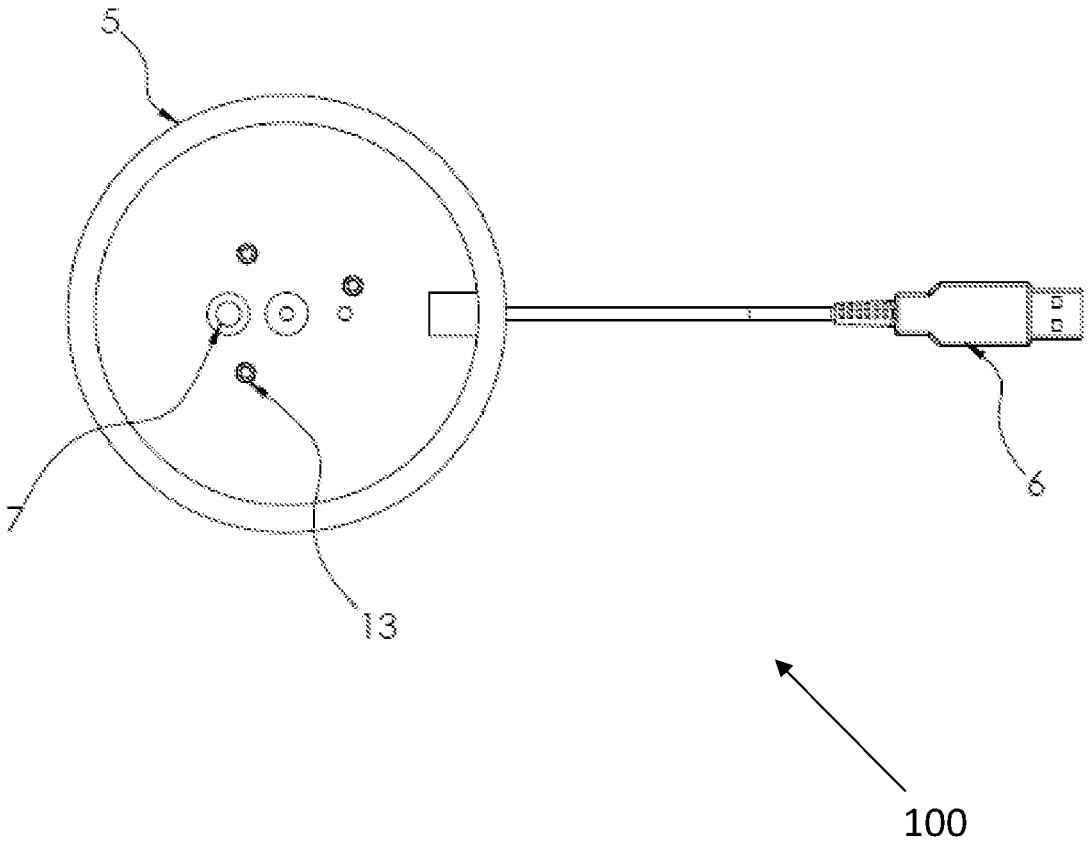
FIG. 4 illustrates a bottom view of an embodiment of an electrically powered suction ashtray system.

FIG. 4 illustrates a bottom view of an embodiment of an electrically powered suction ashtray system 100. The housing 4 is operatively connected to the tray 5 using mounting screws 13. The quantity and location of the threaded fasteners 13 shown is a non-limiting example and other quantities and locations can be implemented. A power switch (e.g. push button) 7 for controlling the on/off operation of the suction ashtray 100 is shown mounted to the bottom of the tray 5. Alternative on/off power switches can be implemented such as a rotary knob or having separate on and off buttons.

Figure 5:
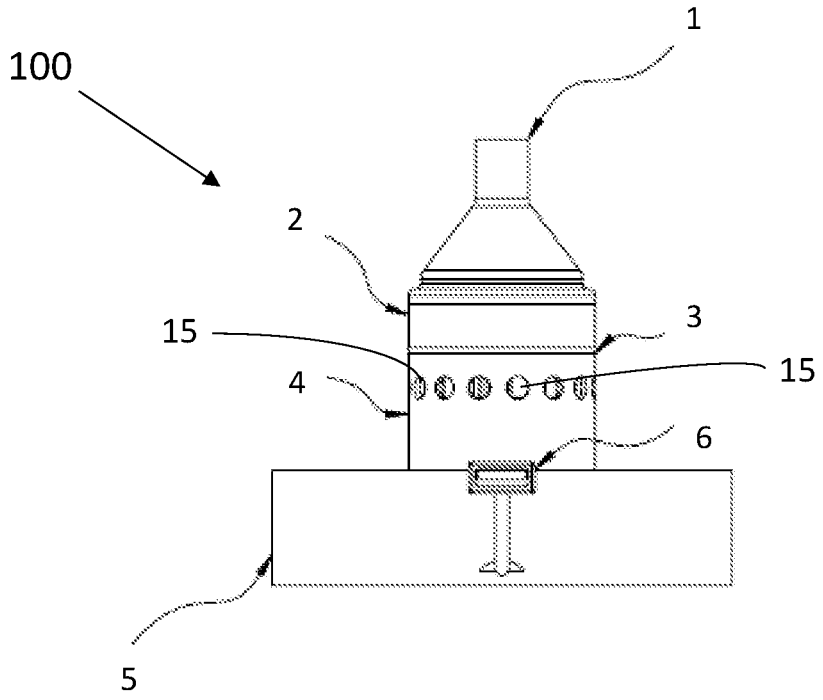
FIG. 5 illustrates a right side view of an embodiment of an electrically powered suction ashtray system.
Figure 6:
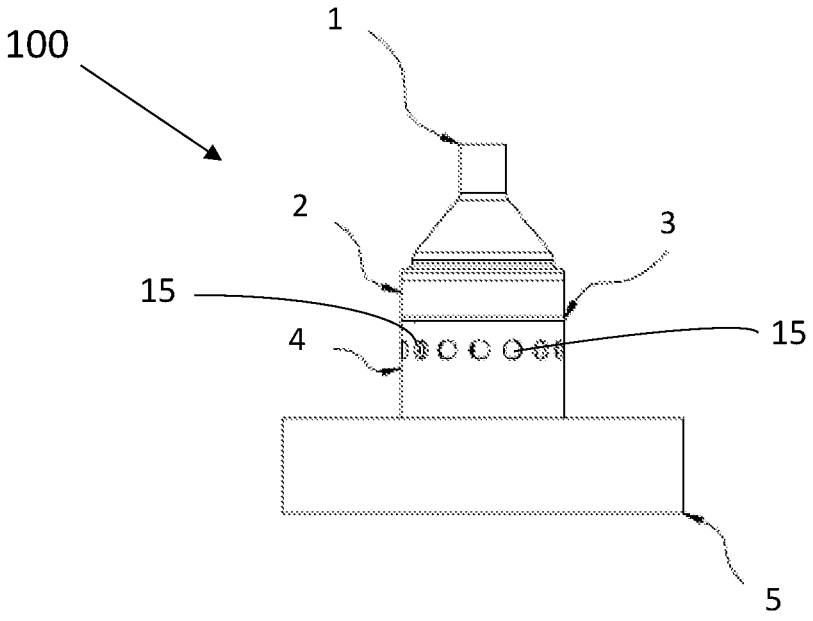
FIG. 6 illustrates a left side view of an embodiment of an electrically powered suction ashtray system.

FIG. 5 illustrates a right side view and FIG. 6 illustrates a left side view of an embodiment of an electrically powered suction ashtray system 100. The housing 4 includes a plurality of air vents 15 that are preferably circular shaped holes. Although the air vents 15 shown are circular shaped, other shapes can be implemented such as horizontal, rectangular, or ovoid shaped. When the suction ashtray 100 is powered on, the motor 12 provides power to the fan blade/impeller 11. The rotation of the fan blade 11 generates a centrifugal force that pushes air from the interior of the housing 4 through the air vents 15 to the exterior. The fan blade 11 rotates at a high rate of speed to create a strong suction (vacuum) force. When a pipe bowl is placed on (or above) the cyclone top 1 and the power switch 7 is turned on, the suction force is strong enough to pull ash and any other particles toward and into the catch compartment 2. The cyclone-shaped top 1 improves suction and enables containment of most particles. The air filter 10 is replaceable and can capture very small particles that are not captured and contained within the catch compartment 2. The cyclone top 1 can be separated from the catch compartment 2 to enable a user to clean out and remove collected particles from the compartment 2. For example, the cyclone top 1 can include male threads and the catch compartment 2 can include female threads so that a user can unscrew the top 1 from the catch compartment 2. Alternatively, the cyclone top 1 can include female threads and the catch compartment 2 can include male threads for connecting the components together.

Figure 7A:
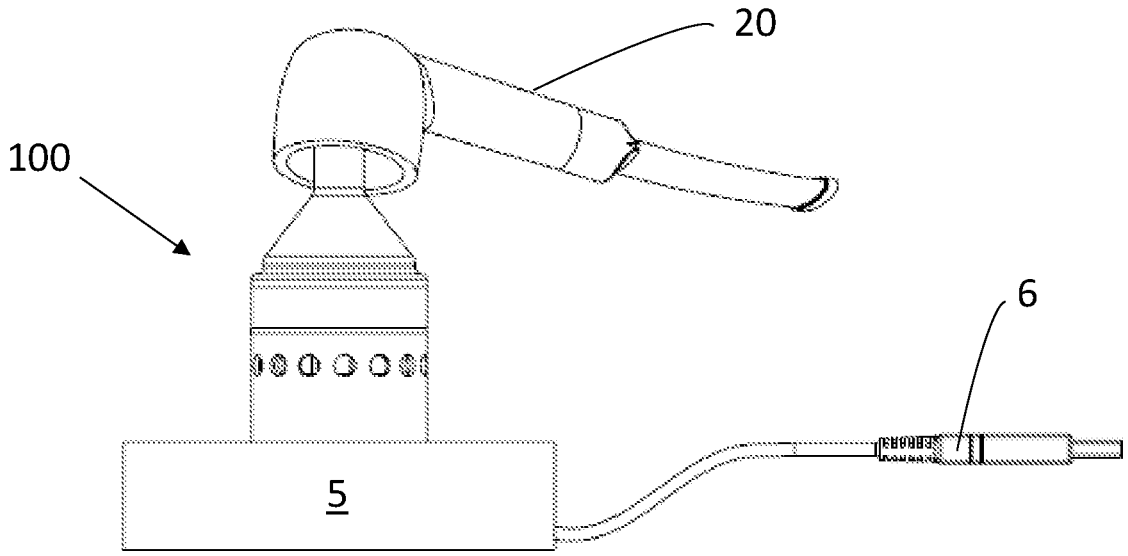
FIG. 7A illustrates a front view of an embodiment of an electrically powered suction ashtray system with a pipe bowl mounted thereon.
Figure 7B:
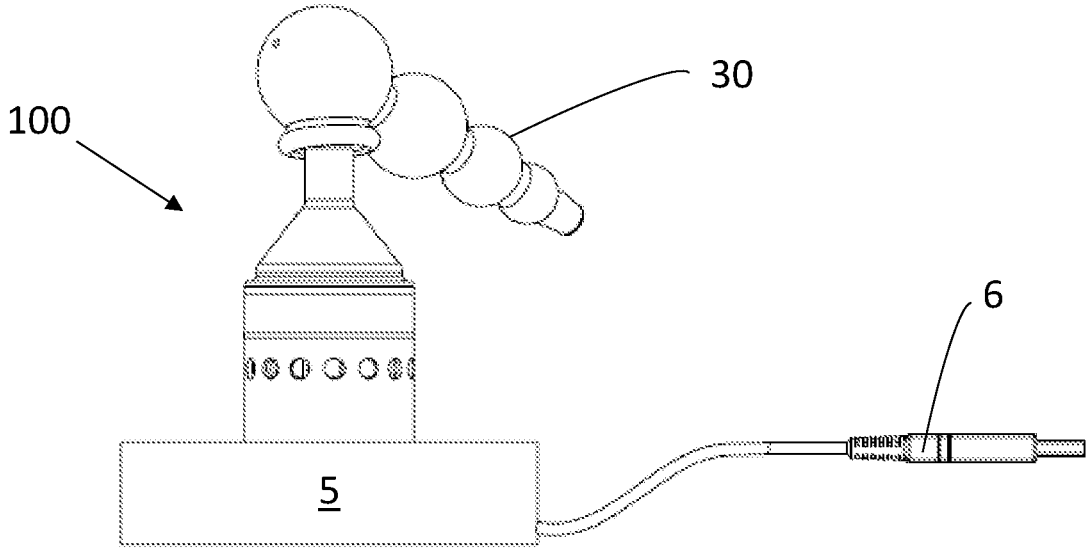
FIG. 7B illustrates a front view of an embodiment of an electrically powered suction ashtray system with a different pipe bowl mounted thereon.

FIG. 7A illustrates a front view of an embodiment of an electrically powered suction ashtray system 100 with a pipe 20 bowl mounted thereon. FIG. 7B illustrates a front view of an embodiment of an electrically powered suction ashtray system 100 with a different pipe 30 bowl mounted thereon. Various types and shapes of pipes and pipe bowls can be utilized by the suction ashtray system 100. A user can place and hold a pipe bowl (e.g. 20, 30) over the cyclone top 1, turn the power on and hold the bowl in place until the particles are removed.

Figure 8:
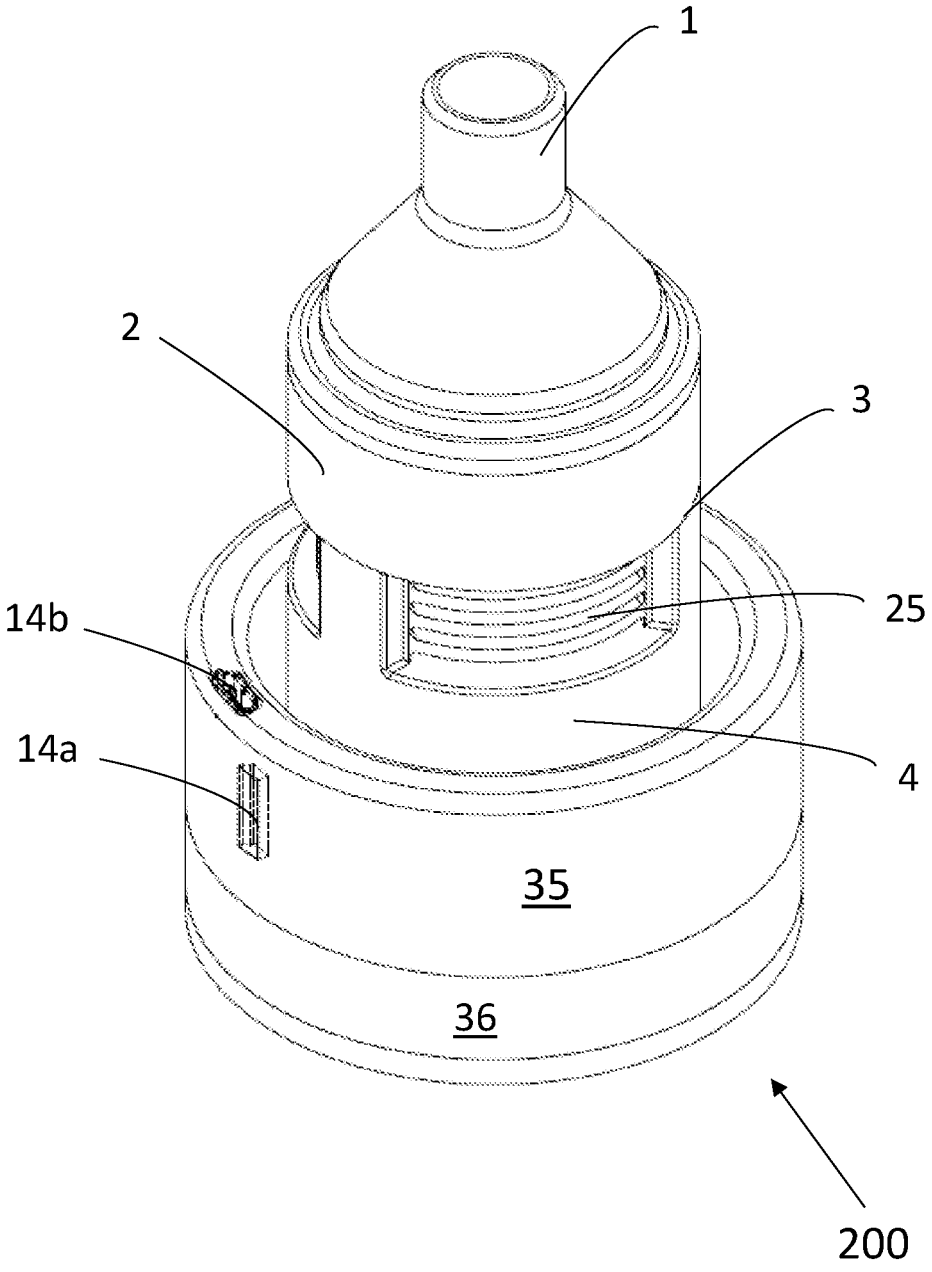
FIG. 8 illustrates a perspective view of an embodiment of an electrically powered suction ashtray system.

FIG. 8 illustrates a perspective view of an embodiment of an electrically powered suction ashtray system 200. A tray 35 supports the housing 4 and other components. Below the tray 35 is a base 36 supporting the ashtray system 200. The base 36 can hold a battery 18 (shown in FIG. 2) and electrical wiring. Alternatively, the battery 18 can be stored inside the housing 4 with other components including the electric motor 12 (shown in FIG. 2). The housing 4 can include one or more outlets 14*a*, 14*b* which enables a power cable 6 (e.g. USB cable) to be connected. The housing 4 includes a plurality of air vents 25. The air vents 25 in this ashtray system 200 are differently shaped and configured than the air vents in ashtray system 100. A pipe bowl can be placed on (or above) an inverted cone-shaped (cyclone) top 1. Below the cyclone top 1 is a catch compartment 2. When the suction ashtray 200 is powered on, ash and any other particles are sucked (vacuumed) through the top 1 into the catch compartment 2. A first gasket 3 provides a seal between the catch compartment 2 and the housing 4. The housing 4 also contains the same aforementioned internal electrical and mechanical components (shown in FIG. 2) as the ashtray system 200.

Figure 9:
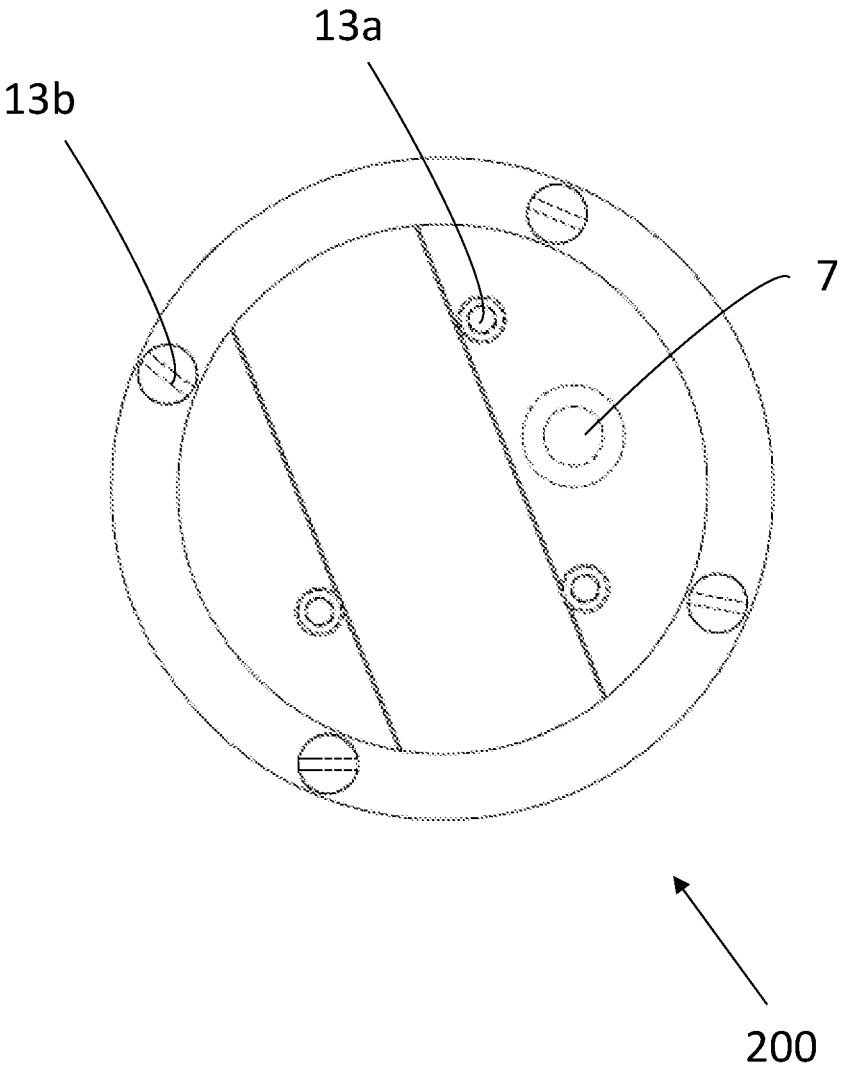
FIG. 9 illustrates a bottom view of an embodiment of an electrically powered suction ashtray system.

FIG. 9 illustrates a bottom view of an embodiment of an electrically powered suction ashtray system 200. The housing 4 is operatively connected to the tray 5 using mounting screws 13*a*, 13*b*. The quantity and location of the threaded fasteners 13*a*, 13*b* shown is a non-limiting example and other quantities and locations can be implemented. A push button 7 for controlling the on/off operation of the suction ashtray 200 is shown mounted to the bottom of the tray 5. Alternative on/off power switches can be implemented such as a rotary knob or having separate on and off buttons.

Figure 10:
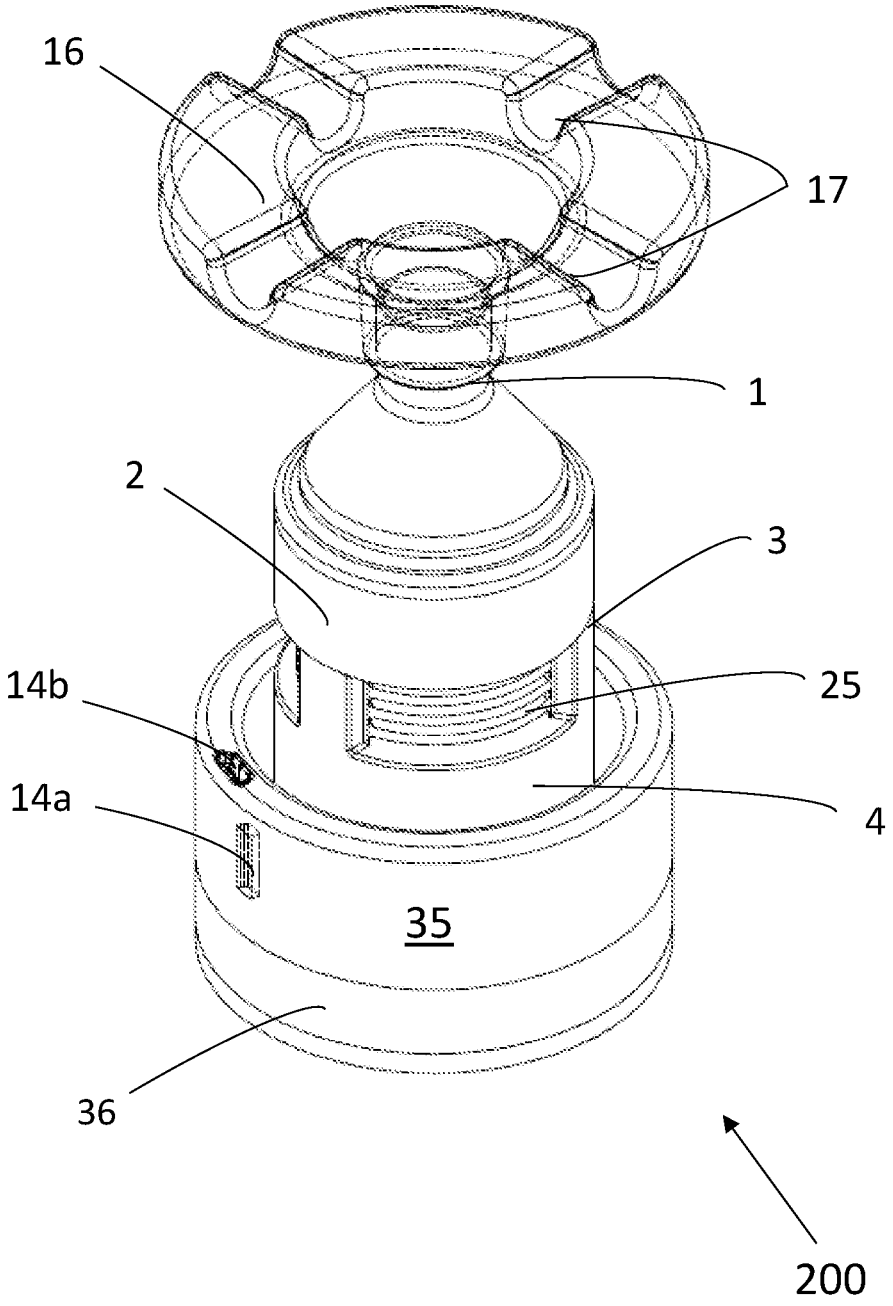
FIG. 10 illustrates a perspective view of an embodiment of an electrically powered suction ashtray system with an ashtray attachment.

FIG. 10 illustrates a perspective view of an embodiment of an electrically powered suction ashtray system 200 with an ashtray attachment 16. The ashtray attachment 16 connects to the cyclone top 1. For example, the ashtray attachment 16 can include male threads and the cyclone top 1 can include female threads so that a user can fasten the components together. Alternatively, the cyclone top 1 can include female threads and the ashtray attachment 16 can include male threads for connecting the components. The ashtray attachment 16 includes a plurality of grooves 17 able to hold a cigarette or similarly sized smoking apparatus. A user can place a cigarette in a groove 17 so that the ash can fall into the cyclone top 1.

Figure 11:
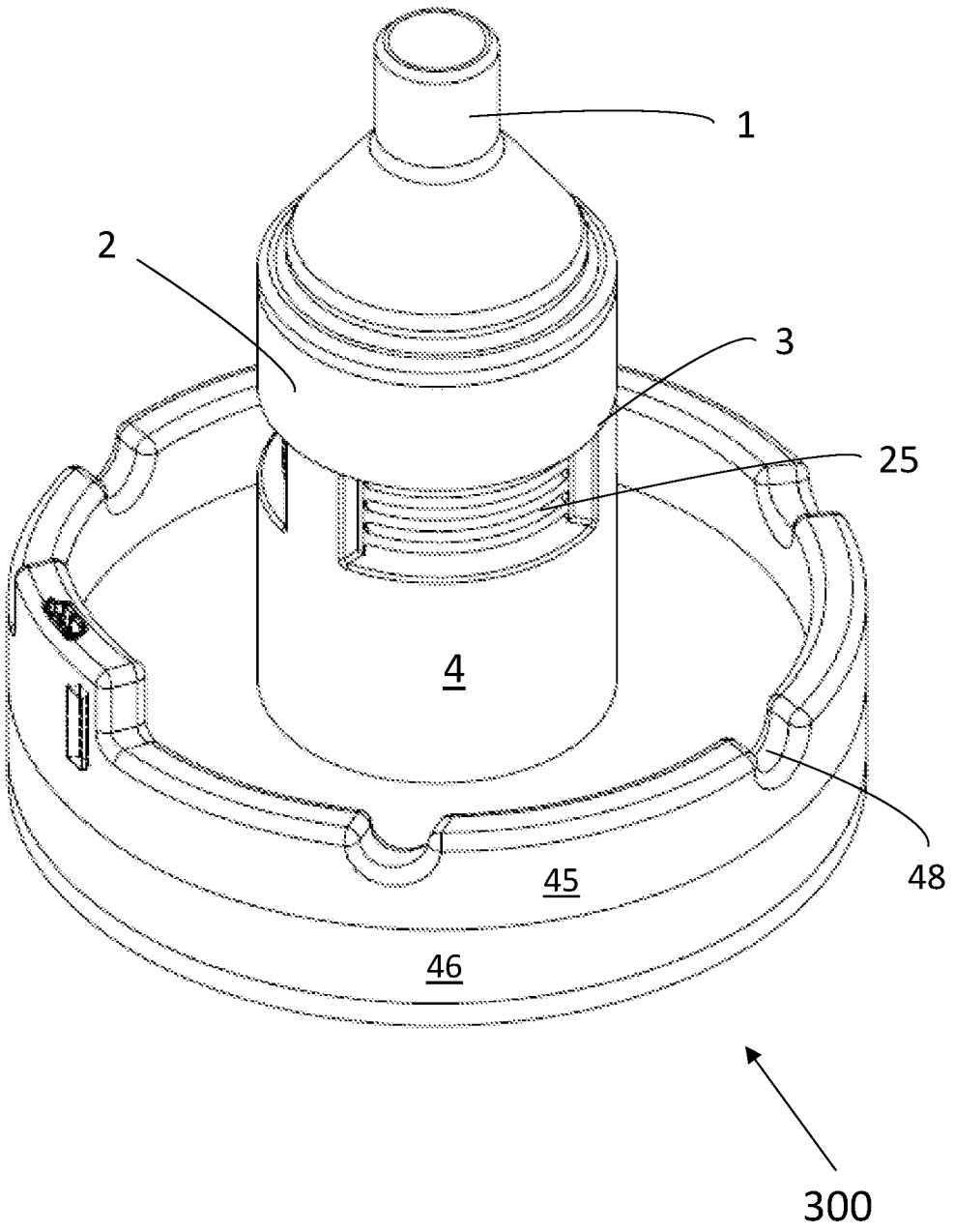
FIG. 11 illustrates a perspective view of an embodiment of an electrically powered suction ashtray device.

FIG. 11 illustrates a perspective view of an embodiment of an electrically powered suction ashtray device 300. A tray 45 supports the housing 4 and other components. Below the tray 45 is a base 46 supporting the ashtray system 200. The base 46 can hold a battery 18 (shown in FIG. 2) and electrical wiring. Alternatively, the battery 18 can be stored inside the housing 4 with other components including the electric motor 12 (shown in FIG. 2). In this ashtray system 300, the tray 45 has a plurality of grooves 48 able to hold a cigarette or similarly sized smoking apparatus. The housing 4 can include one or more outlets 14*a*, 14*b* which enables a power cable 6 to be connected. The housing 4 includes a plurality of air vents 15. The air vents 15 in this ashtray system 300 are differently shaped and configured than the air vents in ashtray system 100. A pipe bowl can be placed on (or above) an inverted cone-shaped (cyclone) top 1. Below the cyclone top 1 is a catch compartment 2. When the suction ashtray 300 is powered on, ash and any other particles are sucked (vacuumed) through the top 1 into the catch compartment 2. A first gasket 3 provides a seal between the catch compartment 2 and the housing 4. The housing 4 also contains the same aforementioned internal electrical and mechanical components (shown in FIG. 2) as the ashtray system 300.

Figure 12:
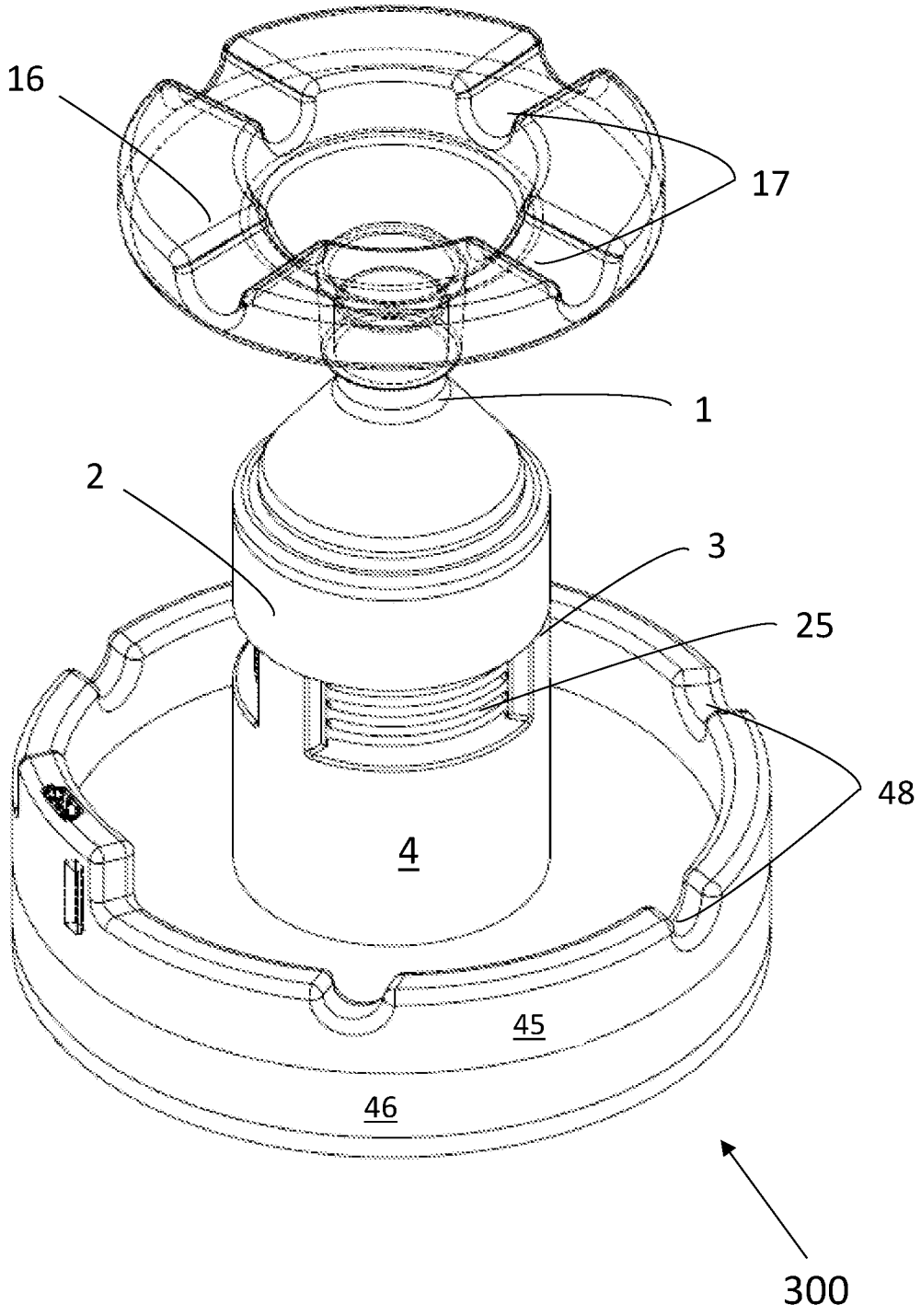
FIG. 12 illustrates a perspective view of an embodiment of an electrically powered suction ashtray system with an ashtray attachment.

FIG. 12 illustrates a perspective view of an embodiment of an electrically powered suction ashtray system 300 with an ashtray attachment 16. The ashtray attachment 16 connects to the cyclone top 1. For example, the ashtray attachment 16 can include male threads and the cyclone top 1 can include female threads so that a user can fasten the components together. Alternatively, the cyclone top 1 can include female threads and the ashtray attachment 16 can include male threads for connecting the components. The ashtray attachment 16 includes a plurality of grooves 17 able to hold a cigarette or similarly sized smoking apparatus. A user can place a cigarette in a groove 17 so that the ash can fall into the cyclone top 1.

The suction ashtray devices 100, 200, 300 disclosed herein can be used for removing ash and other particles generated from cannabis, tobacco, or other products. Pipe bowls and similar devices can be cleaned out using the suction ashtray devices.

The invention claimed is:

1. A suction ashtray device comprising:

a. a tray including an outlet for a power cable;

b. a housing including an electric motor, a fan, a power switch, and a plurality of air vents;

c. wherein the housing is operatively connected to the tray;

d. a catch compartment including an air filter;

e. wherein the catch compartment is configured to collect ash and other particles;

f. a first gasket located between the housing and the catch compartment;

g. a cyclone top including a cone filter;

h. a second gasket located between the catch compartment and the cyclone top;

i. wherein the electric motor provides power to the fan; and j. wherein the fan rotates and generates a suction force when the power switch is turned on.

2. The device of claim 1, further comprising a battery electrically connected to the electric motor.

3. The device of claim 2, further comprising a base operatively connected to the tray, wherein the battery is located in the base.

4. The device of claim 2, wherein the battery is rechargeable using the power cable.

5. The device of claim 4, wherein the power cable is a universal serial bus cable.

6. The device of claim 1, further comprising an ashtray attachment, wherein the ashtray attachment is configured to connect to the cyclone top.

7. The device of claim 1, wherein the cyclone top is configured to separate from the catch compartment, enabling a user to remove particles collected by the catch compartment.

8. A suction ashtray system for cleaning a pipe bowl, the system comprising:

a. a pipe bowl;
b. a tray including an outlet for a power cable;
c. a housing including an electric motor, a fan, a power switch, and a plurality of air vents;
d. wherein the housing is operatively connected to the tray;
e. a catch compartment including an air filter;
f. a first gasket located between the housing and the catch compartment;
g. a cyclone top including a cone filter;
h. a second gasket located between the catch compartment and the cyclone top;
i. wherein the electric motor provides power to the fan when the power switch is turned on;
j. wherein the fan rotates and generates a suction force when the power switch is turned on; and
k. wherein the suction force pulls ash and other particles toward the catch compartment when the pipe bowl is placed on the cyclone top.

9. The system of claim 8, further comprising a battery electrically connected to the electric motor.

10. The device of claim 9, further comprising a base operatively connected to the tray, wherein the battery is located in the base.

11. The device of claim 9, wherein the battery is rechargeable using the power cable.

12. The device of claim 10, wherein the power cable is a universal serial bus cable.

13. The device of claim 8, further comprising an ashtray attachment, wherein the ashtray attachment is configured to connect to the cyclone top.

14. The device of claim 8, wherein the cyclone top is configured to separate from the catch compartment, enabling a user to remove particles collected by the catch compartment.

15. A method of using a suction ashtray device comprising:
a. providing a pipe bowl;
b. providing a housing:
i. wherein the housing includes an electric motor, a fan, a power switch, and a plurality of air vents;
ii. wherein the housing is operatively connected to the tray;
c. providing a catch compartment, wherein the catch compartment includes an air filter;
d. providing a first gasket, wherein the first gasket is located between the housing and the catch compartment;
e. providing a cyclone top, wherein the cyclone top includes a cone filter;
f. providing a second gasket located between the catch compartment and the cyclone top;
g. placing the pipe bowl on the cyclone top;
h. turning the power switch on;
i. providing, via the electric motor, power to the fan;
j. generating, via the fan, a suction force;
k. pulling, via the suction force, ash and other particles toward the catch compartment; and
l. collecting, via the catch compartment, ash and other particles.

16. The method of claim 15, further comprising:
a. providing a battery, wherein the battery is electrically connected to the electric motor.

17. The method of claim 16, wherein the battery is rechargeable using the power cable.

18. The method of claim 17, wherein the power cable is a universal serial bus cable.

19. The method of claim 15, further comprising:
a. providing an ashtray attachment, wherein the ashtray attachment is configured to connect to the cyclone top.

20. The method of claim 15, wherein the cyclone top is configured to separate from the catch compartment, enabling a user to remove particles collected by the catch compartment.

* * * * *